United States Patent [19]

Korbel

[11] 3,933,389

[45] Jan. 20, 1976

[54] GRAPPLE STRUCTURE

[75] Inventor: Adrian Charles Korbel, Dubuque, Iowa

[73] Assignee: Deere & Company, Moline, Ill.

[22] Filed: Oct. 16, 1974

[21] Appl. No.: 515,081

[52] U.S. Cl. ..... 294/88; 214/147 G; 294/106

[51] Int. Cl.[2] ..... B66C 3/16

[58] Field of Search..... 294/88, 106, 110 R, 118, 294/119; 214/77 R, 147 G

[56] References Cited

UNITED STATES PATENTS

| | | | |
|---|---|---|---|
| 2,972,964 | 2/1961 | Allemann | 294/88 X |
| 3,513,998 | 5/1970 | Stone | 294/88 X |
| 3,620,394 | 11/1971 | Symons et al. | 294/106 X |
| 3,627,351 | 12/1971 | Zimmerman et al. | 294/88 X |
| 3,667,796 | 6/1972 | Funk | 294/88 |

*Primary Examiner*—Evon C. Blunk
*Assistant Examiner*—Johnny D. Cherry

[57] ABSTRACT

The upper ends of a pair of grapple tongs are joined through means of a pair of cross link assemblies and an extensible and retractable hydraulic actuator. A pair of suspension link assemblies respectively have lower ends pivotally connected to the upper ends of the pair of tongs and have upper ends pivotally connected to a yoke which is connected to an output shaft of a rotary joint. The geometry of the pivotal connections of the cross and suspension link assemblies with the pair of tongs is such that the actuator undergoes very little vertical translation during the operation thereof and a pair of relatively short fluid hoses extend between the lower end of the rotary joint output shaft and the actuator and pass through the yoke.

2 Claims, 5 Drawing Figures

FIG. 3
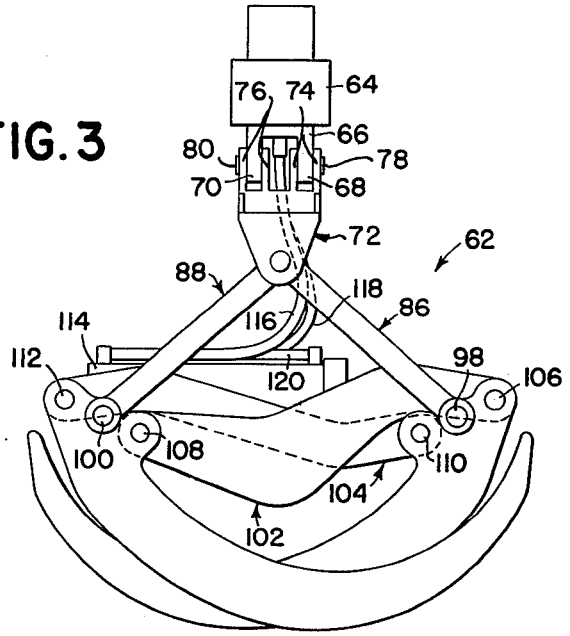
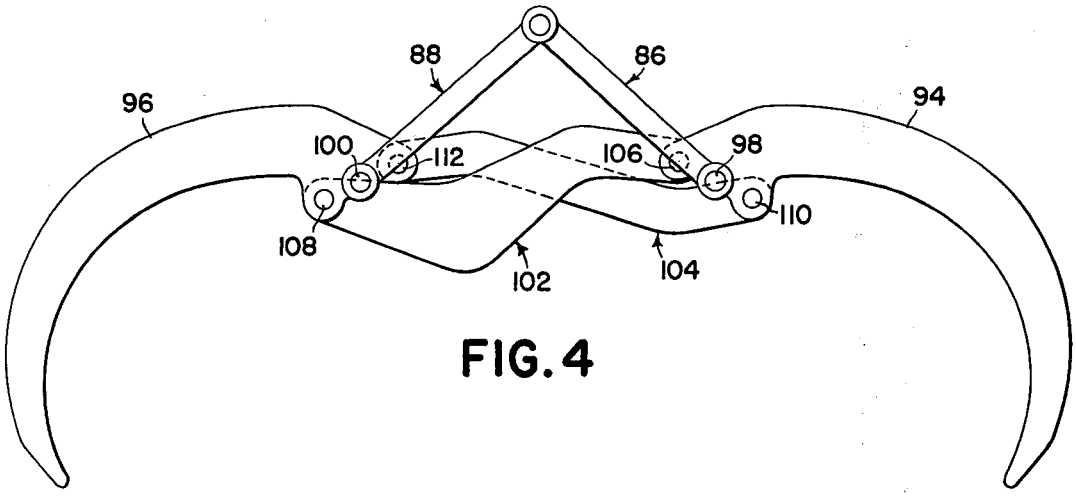
FIG. 4
FIG. 5
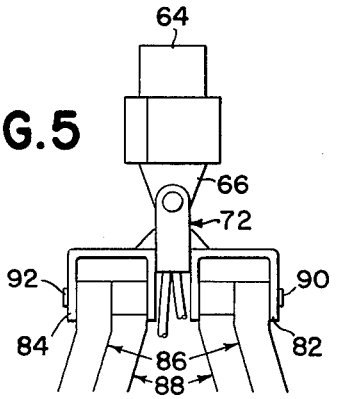

GRAPPLE STRUCTURE

BACKGROUND OF THE INVENTION

The present invention relates to a grapple structure and more specifically relates to an improvement in the grapple structures disclosed in U.S. Pat. Nos. 3,620,394 and 3,667,796 respectively issued to Symons et al and Funk respectively on Nov. 16, 1971 and June 6, 1972.

The grapples disclosed in the above-identified patents are both of a type including a pair of opposed arcuate tongs having upper end portions interconnected through means of a pair of cross link assemblies and an extensible and retractable hydraulic actuator. The tongs of the patented structures are suspended from a swivel joint through means of a pair of suspension link assemblies having respective lower ends connected to the pair of tongs so as to share the pivotal connection of a respective end of one of the cross link assemblies with a tong, and respective upper ends connected to a universal connector joined to an output shaft of the swivel joint.

It has been found that the above-described grapple structure is not entirely satisfactory since the points of connection of the actuator and the cross and suspension link assemblies are so related that the actuator undergoes substantial vertical movement during its actuation for opening and closing the grapple tongs. This movement is underside since it requires that a pair of hoses connected undesirable the swivel joint and the actuator for supplying fluid to and exhausting fluid from the actuator be of sufficient length to accommodate the movement. These relatively long hoses have parts which project outwardly in the area below the swivel joint and above the grapple tongs and are thus vulnerable to being damaged by being struck by or coming into contact with trees or the like during operation of the grapple structure.

SUMMARY OF THE INVENTION

According to the present invention, there is provided a novel grapple structure of the type including a pair of arcuate tongs having respective upper end portions interconnected by a pair of cross link assemblies and an extensible and retractable actuator and suspended from a swivel joint through means of a pair of suspension link assemblies.

An object of the invention is to provide a grapple structure of the type described in the foregoing paragraph wherein the geometry of the parts thereof is such that the hydraulic actuator undergoes very little vertical displacement during its operation in opening and closing the grapple tongs. Specifically, it is an object to provide such a grapple structure wherein the suspension link assemblies have lower ends attached to the grapple tongs at respective locations midway between the respective locations whereat the ends of the cross link assemblies are connected to the grapple tongs.

A further object of the invention is to provide a structure wherein a pair of fluid conveying hoses are routed so as to be protected from damage.

These and other objects will be apparent from a reading of the following specification in conjunction with the appended drawings.

BRIEF DESCRIPTION OF THE DRAWINGS

FIG. 3 is a rear elevational view of a grapple structure of the present invention connected to a rotary joint and being shown in a fully closed condition.

FIG. 4 is a view similar to FIG. 3, but showing only the grapple structure (absent the hydraulic actuator) in a fully open condition.

FIG. 5 is a side elevational view showing the connection between the suspension links and the rotary joint of the present invention.

DESCRIPTION OF THE PREFERRED EMBODIMENT

Figure 1:
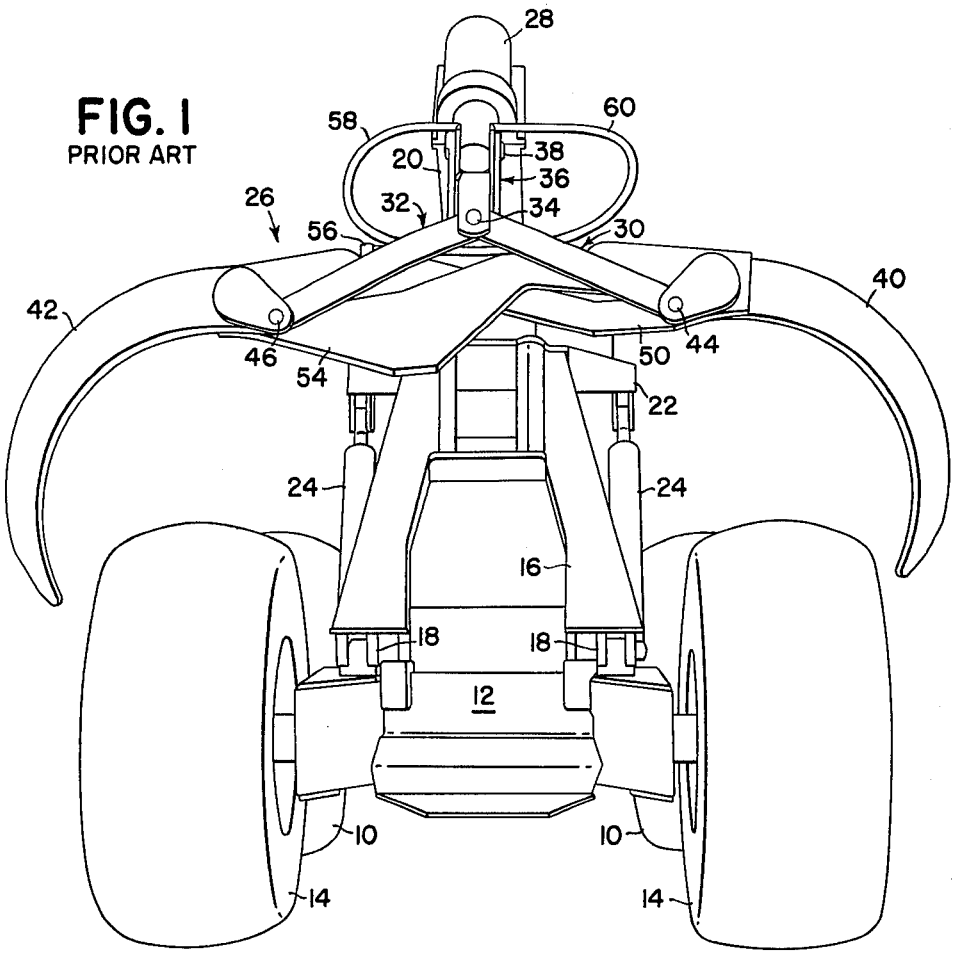
FIG. 1 PRIOR ART
FIG. 1 is a rear elevational view of a grapple skidder embodying a grapple structure constructed according to the prior art and shown in an open condition.

Referring now to FIG. 1, therein is shown a wheeled industrial vehicle of the type with which the present invention is particularly adapted for use. Specifically, the vehicle is of an articulated type including a front frame section (not shown) supported on a pair of front drive wheels 10 and pivotally connected to a rear frame section 12 supported by a pair of rear drive wheels 14. Mounted on the rear frame section 12 is a boom structure including a generally A-shaped main section 16 having transversely spaced legs securely mounted, as at 18, to the vehicle frame section 12 for swinging about a transverse horizontal axis defined by the connection 18. A fore-and-aft extending boom section 20 is pivotally connected intermediate front and rear ends thereof to the top of the A-shaped boom section 16, in a manner not shown, for swinging movement about a horizontal pivot axis. Forming the forward end of the boom section 20 is a cross arm structure 22 having a pair of hydraulic actuators 24 respectively connected between the opposite ends thereof and the frame section 12, the actuators 24 being of an extensible and retractable type which are operative to cause the boom section 20 to be pivoted about its connection with the top of the boom section 16.

The boom structure forms no part of the present invention, however, if it is desired to study a more complete illustration of a boom structure of a similar type, resort may be had to U.S. Pat. No. 3,731,827 granted to Eaves on May 8, 1973.

For the purpose of delineating applicant's contribution to the art, a prior art grapple structure 26 is shown coupled to the output shaft of a conventional rotary joint 28 forming the rearward end of the boom section 20. As viewed in FIGS. 1 and 2, the grapple structure 26 includes right and left suspension or hanging link assemblies 30 and 32, respectively. As can best be seen in FIG. 2, each of the link assemblies 30 and 32 includes a pair of links having upper ends pivotally connected by a pin 34 to a universal connection 36 having its upper end pinned, as at 38, to the lower end of the output shaft of the rotary joint 28. The lower ends of the right and left suspension link assemblies 30 and 32 are respectively pivotally connected to right and left grapple tongs 40 and 42 by means of respective pivot pins 44 and 46. The pins 44 and 46 are respectively spaced from the upper ends of the grapple tongs 40 and 42 as viewed in FIGS. 1 and 2 and connected between the pivot pin 44 and a pin 48 adjacent the upper end of the grapple tong 42 is a first cross link assembly 50 while connected between the pivot pin 46 and a pivot pin 52 located adjacent the top of the grapple tong 40 is a second cross link assembly 54. Like the suspension link assemblies 30 and 32, the link assemblies 52 and 54 each comprise a pair of links.

Figure 2:
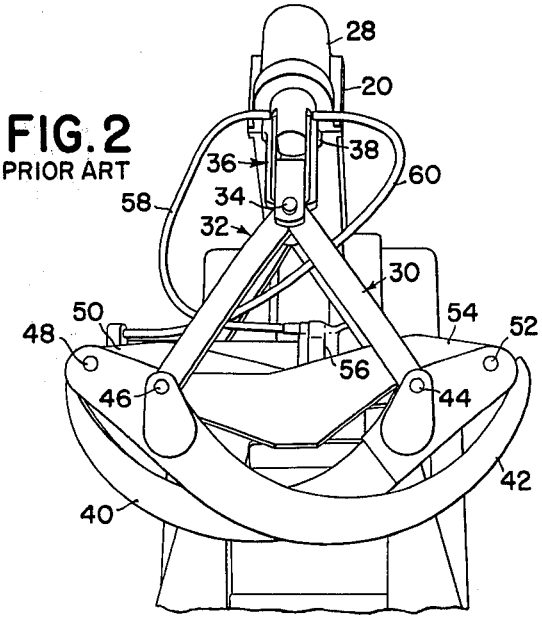
FIG. 2 PRIOR ART
FIG. 2 is a view similar to FIG. 1, but omitting part of the vehicle and showing the grapple structure in a closed condition.

The cross link assemblies 50 and 54 act to cause the grapple tongs 40 and 42 to move symmetrically when they are swung towards and away from each other between the opened and closed positions shown in FIGS. 1 and 2 and for the purpose of selectively moving the grapple tongs between their opened and closed positions there is provided an extensible and retractable hydraulic actuator 56 including a cylinder having one end pivotally connected to the pivot pin 48 and a rod pivotally connected to the pivot pin 52. Working and exhaust fluid is carried to and from the right and left ends of the cylinder of the actuator 56 respectively through means of fluid hoses 58 and 60 having lower ends connected to the cylinder and upper ends connected to couplings at the opposite sides of the output shaft of the rotary joint 28. The rotary joint 28 acts as a fluid manifold, in a manner well known in the art, for transferring pressure fluid from a pump (not shown) mounted on the vehicle to the actuator and for transferring exhaust fluid from the actuator to a reservoir (not shown) located on the vehicle.

Of significance relative to the present invention, it is to be noted that the hydraulic actuator 56 undergoes considerable vertical travel during opening and closing operation of the grapple tongs 40 and 42 thus necessitating that the fluid hoses 58 and 60 be sufficiently long to accommodate this travel. The present invention is directed to the end of eliminating this vertical travel of the hydraulic actuator 56.

Referring now to FIG. 3, therein is shown a grapple structure 62 constructed according to the principles of the present invention. The grapple structure 62 includes a rotary joint 64 adapted for securement to the rear end of a boom section such as the boom section 20 illustrated in FIGS. 1 and 2. The rotary joint 64 differs from the rotary joint 28 in that it includes a bifurcated output shaft 66 having downwardly projecting right and left legs 68 and 70, respectively, as shown in FIG. 3. A universal connector in the form of a connecting yoke 72 includes right and left pairs of upwardly extending lugs 74 and 76, respectively, forming upwardly opening clevises having the right and left legs 68 and 70 of the output shaft 66 received therebetween and connected thereto by right and left pivot pins 78 and 80. As can best be seen in FIG. 5, the connecting yoke 72 also includes transversely spaced right and left pairs of downwardly extending lugs 82 and 84 forming downwardly opening clevises. As viewed in FIG. 3, the grapple structure includes right and left suspension or hanging link assemblies 86 and 88 having their upper ends respectively received between the pairs of lugs 82 and 84 and respectively connected thereto through means of pins 90 and 92. The lower ends of the right and left pairs of suspension link assemblies 86 and 88, respectively, are pivotally connected to upper end portions of a pair of arcuate grapple tongs 94 and 96 through means of right and left pivot pins 98 and 100.

The upper ends of the pair of grapple tongs 94 and 96 are connected together through means of first and second cross link assemblies 102 and 104, the former having its right end pivotally connected, as at a pin 106, to the right grapple tong 94 at a location above the pivot pin 98 and has its left end pivotally connected to the left grapple tong 96, as at pin 108, at a location below the pivot pin 100. The cross link assembly 104 has its right end pivotally connected to the grapple tong 94, as at pin 110, at a location below the pivot pin 98 while the left end of the link assembly 104 is pivotally connected to the grapple tong 96, as at pin 112, at a location above the pivot pin 100. The pivot pins 106 and 110 are respectively located equidistant from the pivot pin 96 and the pivot pins 108 and 112 are similarly located equidistant from the pivot pin 100.

An extensible and retractable hydraulic actuator 114 is pivotally connected at its opposite ends to the grapple tongs 94 and 96 through means of the pivot pins 106 and 112. Passing centrally through the connecting yoke 72 and having upper ends coupled to connections at the lower end of the output shaft 66 of the rotary joint 64, and having lower ends connected to couplings at the left end of the hydraulic actuator 114 are a pair of fluid hoses 116 and 118 for conveying exhaust and pressure fluid to and from the hydraulic actuator 114. The hose 118 is in fluid communication with a pipe 120 which extends from the left end to the right end of the actuator 114. It is here noted that the rotary joint 64 serves as a rotary manifold in a manner well known in the art so as to convey fluid from and to pressure and return fluid hoses (not shown) located on the boom section 20 to the fluid hoses 116 and 118.

It will be appreciated then that the pivot pins 98 and 100 connecting the lower ends of the suspension or hanging link assemblies 86 and 88 to the grapple tongs 94 and 96 serve as instant centers for the rotation of the grapple tongs thereabout when the hydraulic actuator 14 is extended or retracted. As can best be seen in FIGS. 3 and 4, the pivot pins 106 and 112 to which the opposite ends of the actuator 114 are connected will undergo only a small vertical rise as the grapple tongs 94 and 96 are moved from their fully closed position shown in FIG. 3 to their fully open position shown in FIG. 4 and that during this movement of the grapple tongs 94 and 96 the fluid hoses 116 and 118 will remain substantially in their respective positions shown in FIG. 3 wherein they are protected by the yoke 72 and the suspension link assemblies 86 and 88.

The operation of the grapple structure 62 is thought to be apparent from the foregoing description and for the sake of brevity no further description is given.

I claim:

1. In a grapple skidder including a wheel-supported frame having a boom means supported thereon, a rotary joint mounted at a free end of the boom means and having a normally downwardly projecting output shaft, a universal connector means pivotally connected to the output shaft and to upper ends of first and second suspension link assemblies of a grapple structure, first and second arcuate grapple tongs having upper end portions respectively pivotally connected to lower ends of said first and second suspension link assemblies for swinging movement about respective first and second axes; first and second cross link assemblies crossing each other midway between and having respective opposite first and second ends respectively pivotally connected to the upper end portions of said first and second grapple tongs, an extensible and retractable hydraulic actuator means coupled between said upper end portions of said first and second tongs and a pair of fluid hoses interconnected between said output shaft of the rotary joint and said hydraulic actuator, the improvement comprising: said respective first ends of the first and second cross link assemblies respectively being connected to the upper end of the first grapple tong at locations equidistant from and on opposite sides of said first axis; and said respective second ends of the first and second cross link assemblies respectively being connected to the upper end of the second grapple tong at locations equidistant from and on opposite sides of said second axis.

2. The grapple skidder defined in claim 1 wherein said universal connector has a passageway extending downwardly therethrough; said output shaft of said rotary joint having a pair of fluid hose couplings at the lower end; and said pair of fluid hoses extending through said passageway between said pair of fluid hose couplings and said actuator.

* * * * *